US005552165A

United States Patent [19]

Haak et al.

[11] Patent Number: 5,552,165

[45] **Date of Patent: *Sep. 3, 1996**

[54] INFUSION PACKAGE

[75] Inventors: Robert H. A. Haak, Delft; Jan J. Kuipers, Goudswaard, both of Netherlands; Craig S. McLean, Northampton, Great Britain

[73] Assignee: Thomas J. Lipton Co., Division of Conopco, Inc., Englewood, N.J.

[ * ] Notice: The term of this patent shall not extend beyond the expiration date of Pat. No. 5,552,164.

[21] Appl. No.: 335,029

[22] Filed: Nov. 7, 1994

[30] Foreign Application Priority Data

Nov. 8, 1993 [GB] United Kingdom ..... 9322995
Oct. 3, 1994 [GB] United Kingdom ..... 9419895

[51] Int. Cl.[6] ..... B65B 29/04

[52] U.S. Cl. ..... 426/80; 426/77; 426/83; 206/0.5; 53/134.2

[58] Field of Search ..... 426/77, 80, 83, 426/78, 79, 81, 82, 84; 53/134.2, 413; 206/0.5

[56] References Cited

U.S. PATENT DOCUMENTS

| | | | |
|---|---|---|---|
| 2,466,281 | 4/1949 | Shaw | 426/80 |
| 2,878,927 | 3/1959 | Haley | 426/80 |
| 2,881,910 | 4/1959 | Murphy | 426/80 |
| 3,237,550 | 3/1966 | Christopher | 426/80 X |
| 3,415,656 | 12/1968 | Lundgren | 426/80 X |
| 3,539,355 | 11/1970 | Kasakoff | 426/80 |
| 3,597,222 | 8/1971 | Kalemba | 426/83 X |
| 3,692,536 | 9/1972 | Font | 426/77 X |
| 5,366,741 | 11/1994 | Von Der Zon | 426/80 X |

FOREIGN PATENT DOCUMENTS

| | | |
|---|---|---|
| WO91/13580 | 9/1991 | WIPO . |
| WO92/06903 | 4/1992 | WIPO . |
| WO93/19997 | 10/1993 | WIPO . |

*Primary Examiner*—Esther M. Kepplinger
*Assistant Examiner*—Milton I. Cano
*Attorney, Agent, or Firm*—James J. Farrell

[57] ABSTRACT

A package for containing a flowable infusible material comprising a closed bag made from a porous material. The bag has a first side, a second side that opposes the first side and two other sides. The package also has a drawstring that passes out of the interior of the package via a first exit point located adjacent one end of the first side and a second exit point located adjacent the other end of the first side. Means are provided to constrain the drawstring against adjacent the ends of the second side and at some intermediate point along each of said other sides (preferably near the midpoint). The arrangement being such that pulling the ends of the drawstring in substantially opposite directions causes the drawstring to move relative to the sides it engages and thus enable the package to collapse.

2 Claims, 3 Drawing Sheets

INFUSION PACKAGE

FIELD OF THE INVENTION

This invention relates to packages containing a flowable material, particularly but not exclusively an infusible material such as tea or coffee, wherein the package has means for applying pressure on the contents of the packages to express liquid from the package after infusion.

BACKGROUND OF THE INVENTION

Tea leaves are often sold in bags that are made from a porous material and placed in a cup or pot of hot water to infuse. In most cases the bag is removed from the water and prior to drinking the tea.

These bags often contain a significant volume of liquid when they are removed from the infusion liquid. This can make the bags unpleasant to deal with in terms of feeling soggy and tending to drip onto and even stain the user's clothing, table linen etc.

Attempts have been made to overcome or at least alleviate this problem by providing the bags with means for squeezing or wringing at least some of the liquid from the bags after use.

U.S. Pat. Nos. 3,539,355, 3,237,550, 2,881,910, 2,878,927 and 2,466,281 disclose infusion bags having drawstrings that are threaded through holes in the walls of the bag. However, dry infusible material can leak out of the bags prior to use, the holes weaken the structure of the bags thus encouraging them to tear and release their contents, and liquid can leak through the holes during squeezing action.

WO 91/13580 discloses analogous examples in which the drawstring may be retained at desired locations by staples driven through the walls of the bag. This similarly creates leakage paths and local weaknesses at regions where the drawstring tension is likely to be applied the bag.

Further examples of squeezable bags include U.S. Pat. No. 3,415,656, WO 92/06903 and WO 93/19997 which have envelopes formed by two rectangular layers of sheet material that are heat sealed together around their edges. A loop of thread is held in the bag by being trapped in the heat sealed margins at least at one region of those margins remote from one end of the bag where the ends of the loop emerge through the heat sealed margin at that end. This arrangement introduces another potential problem in that the heat seal where the thread is trapped is placed under stress when the bag is contracted and if it fails the bag is opened. Since this is likely to occur at the lower end of the bag, the solid contents would be spilled immediately. It is also noted that these earlier proposals do not suggest how the infusion packages can be economically produced.

OBJECT OF THE INVENTION

It is an object of the present invention to provide a squeezable infusion package that overcomes at least some of the deficiencies of the prior art, or at least provides the consumer with a useful alternative.

DEFINITION OF THE INVENTION

According to the present invention there is provided a package for containing a flowable infusible material comprising a closed bag made from a porous material which is defined by a first side, a second side that opposes the first side and two other sides, said package having a drawstring that passes out of the interior of the package via a first exit point located adjacent one end of the first side and a second exit point located adjacent the other end of the first side, the package being characterised in that it has means which constrains the drawstring adjacent the ends of the second side and at some intermediate point along each of said other sides, the arrangement being such that pulling the ends of the drawstring in substantially opposite directions causes the drawstring to move relative to the sides it engages and thus enable the package to collapse.

Preferably the drawstring is constrained by spot welds and constrained is constrained adjacent the midpoint of each of said side walls.

DESCRIPTION OF THE INVENTION

The invention will now be described in detail with reference to the schematic drawings that accompany this specification by way of a non-limiting preferred embodiment.

The package of the invention is preferably rectangular or square in shape but other shapes could be adopted without departing from the spirit of the invention. It preferably contains tea, be that black, green, oolong or rooibos etc, but other infusible substances such as coffee could be used in addition to flavourings, colouring agents, sweeteners, whiteners, vitamin supplements and the like. Tea or coffee might also be blended with instant or powdered tea or coffee.

The package comprises a closed bag 1 and a drawstring 3. The bag can be made from a porous material such as filter paper, muslin, nylon, polypropylene or other synthetic mesh or the like. The bag 1 may comprise two panels that are sealed (preferably heat sealed) together or one oblong panel or strip that is folded in half and then sealed along the free edges. Folding a single panel is preferred as this maximises the rate of infusion through the peripheral margin formed by the folding.

Figure 1:
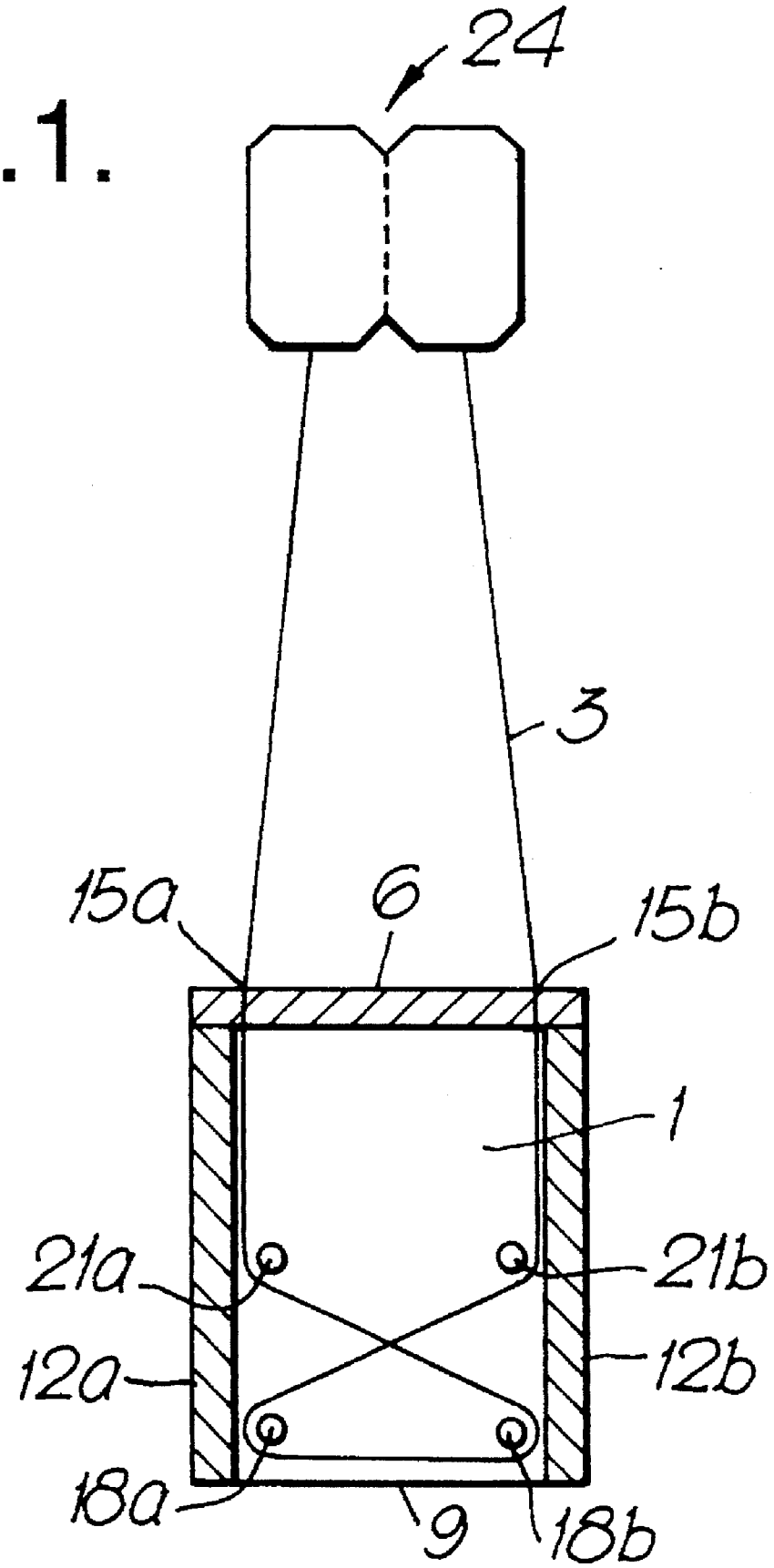
FIG. 1 represents a package of the present invention.

The bag 1 has a first wall 6, a second wall 9 that opposes the first wall (for example such that they are substantially parallel to one another) and two side walls 12*a* and 12*b*. The preferred form of bag of the invention as shown in FIG. 1 is rectangular in shape.

The drawstring 3 may be a cotton or plastics strip or thread or the like. The drawstring is at least partially contained within the interior of the bag and emerges from same at exit points 15*a* and 15*b* which are located adjacent the respective ends of the first wall 6.

The drawstring 3 within the bag 1 is constrained adjacent adjacent opposite ends and of the second wall 9 and at some intermediate point 21*a* and 21*b* along side walls 12 and 12*b* respectively. The points of constraint 18*a*, 18*b*, 21*a* and 21*b* are such that the drawstring 3 can move relative to them, ie slide between them as if they were pulleys. This can be achieved by art-known means such as attaching loosely fitted staples or providing spot or line welds or seals at the appropriate locations. Spot welds are preferred when using filter paper. These may conveniently be between about 2 and about 5 mm in diameter, but preferably between about 3 or about 4 mm.

The inventor has found that it is generally undesirable for the drawstring to be anchored (ie. immovably fixed) into the second wall 9. This is because the seal between the panels tends to give way when the drawstrings are pulled thus allowing the contents of the bag to flow from the bag.

The drawstring 3 is arranged within the interior of the bag so that two portions of the drawstring cross-over each other between the points of constraint 18*a*, 18*b*, 21*a* and 21*b*. In that way pulling the ends of the drawstring 3 in substantially opposite directions causes the package to collapse and expel excess liquid from the package.

The portion of the drawstring that is contained in the interior of the bag is preferably placed in position between the panels of the bag prior to sealing. This can be achieved using the technology disclosed in the specification of our United Kingdom patent application 9321034.2 (Case no. F7068). The contents of the specification of that application should be considered to be incorporated herein by way of reference.

A tag 24 may be attached at one but preferably both ends of the drawstring by art-known means such as gluing or stapling. The tag can be of any shape such as rectangular, square, triangular or round and may take the form of part of a splittable tag such as is shown in FIG. 1.

The infusion package of the invention, more particularly the demonstration of the superior squeezing efficiency of same, will now be described with reference to the following non-limiting example.

EXAMPLE

The infusion package of the invention was selected from a number of designs such as those disclosed in British patent application 9322995.3 as providing a superior squeezing performance or "squeezing efficiency". That efficiency is defined as the percentage of the mass of liquid squeezed out of the package divided by the mass of liquid that had been absorbed by the bag prior to squeezing.

Clearly squeezing packages by hand is too unreliable a method to generate meaningful measurements. The speed, force and angle of pulling the drawstring can affect the measurements so we built or rather customised a machine to simulate that operation in a standard way.

Figure 2:
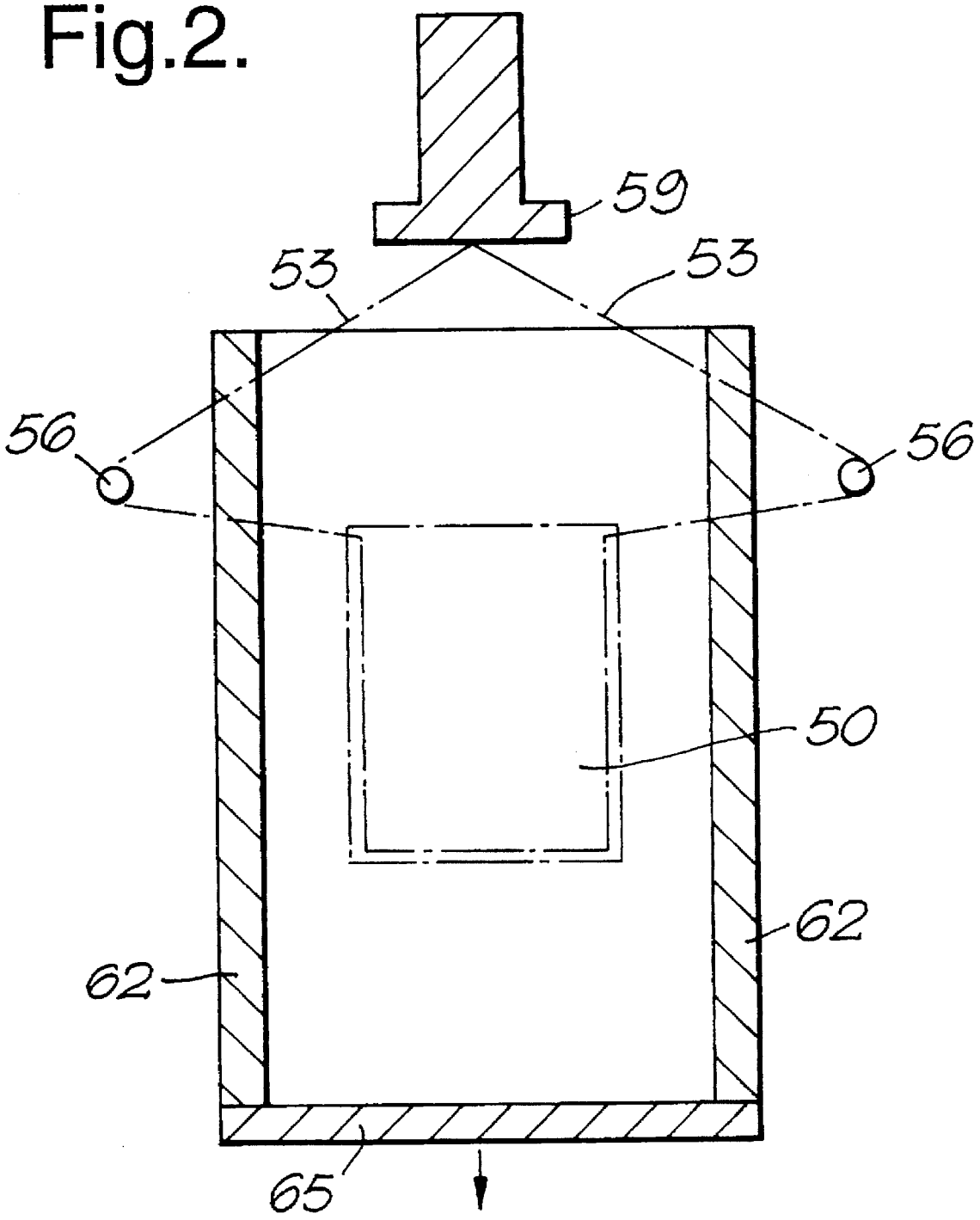
FIG. 2 represents a machine that can be used to measure the squeezing efficiency of squeezable infusion packages such as that of the present invention.

The machine was a ZWICK tensile tester 1445, that is a commercially available fully automatic machine which places test pieces in a loading carriage and measures certain chosen parameters. For present purposes we modified the machine to pull the ends of the drawstring of a variety of squeezable tea bags to squeeze liquid from them and collect and measure the mass of that liquid. The digital output was fed to a computer for recording and analysing. The test area of the customised tensile tester is illustrated in FIG. 2. In that figure a test bag 50 is mounted in the machine such that each end of the drawstring 53 passes about a messing wheel 56 before being securely fixed to the grip system 59. Each messing wheel 56 is fixed to a vertically projecting iron bar 62 that projects vertically from a table 65. The messing wheels remain 165 mm apart in the same horizontal plane. The grip system 59 is positioned equidistant the messing wheels 56 and initially lies 105 mm directly above the horizontal plane occupied by the messing wheels 56. The squeezing action arises as the table 65 is moved downwards at a predetermined rate with respect to the grip system 59. The following test parameters were used:

| | |
|---|---|
| Load cell capacity | 500 N |
| Test Speed | 1000 mm. $min^{-1}$ |
| Speed to pre-load | 50 mm. $min^{-1}$ |
| Pre-load Fv | 0.1 N |
| Break recognition | 50 N |

A video camera was used to record the squeezing of the packages so that the act of squeezing may be reviewed and analysed. That record was used in conjunction with plotted data to calculate the actual squeezing force (N) of the packages and the breaking force of the thread. And by reviewing the video record of the squeezing action at various speeds we were able examine the nature of the squeezing in detail. We also inspected all squeezed packages visually, noting their when freshly squeezed and unfolding the squeezed bags to check critical areas of the bag such as seams, drawstring exit points and spot welds for damage.

The packages tested include those illustrated in FIG. 3 (ie. 3*a* to 3*g*). The infusion packages themselves, in this case tea bags, were made manually using custom made equipment to standard the bags as much as possible. The drawstrings were intentionally longer than is customary for commercial available string and tag bags but only to provide sufficient string to mount the bags neatly onto the tensile testing machine.

The tests were carried out as follows:

The mass of a dry bag was measured using an analytical weighing device. The tea bag was immersed into freshly boiled demineralised water for one minute then transferred to the tensile tester and clamped into the grip system. Previous tests had showed us that the grip system is of crucial importance to the successful completion of the squeeze test. The favoured grip system is a grip with a screw to fix the drawstring.

The tensile tester was started using a load cell with a maximum load capacity of 500 N to follow it's squeeze program (see test parameters below). The machine recorded the force exerted on the bag as the ends of the drawstring where pulled apart and the readings were plotted on screen and paper. Once the tea bag had been squeezed by the tensile tester the bag was removed from the grip system and the mass of the bag measured and recorded.

The "squeezing efficiency" of each bag is the fraction of the mass of liquid squeezed out of the wet bag (ie liquid expressed) per the mass of liquid absorbed by the wet bag prior to any squeezing (ie liquid uptake), expressed as a percentage. That is, in other words, the difference of the mass of the wet unsqueezed bag and the mass of the wet squeezed bag divided by the difference of the mass of wet unsqueezed bag and the mass of the dry unsqueezed bag, multiplied by 100.

$$\text{Squeezing efficiency} = \frac{\text{Mass of liquid expressed by squeeze}}{\text{Mass of liquid absorbed before squeeze}} \times 100$$

$$= \frac{(\text{Wet mass} - \text{Mass after squeeze})}{(\text{Wet mass} - \text{dry mass})} \times 100$$

We found that this parameter together with the graphic representation of the squeeze and the video record provided a very useful picture of the way in which squeezable bags function and perform.

Figure 3A:
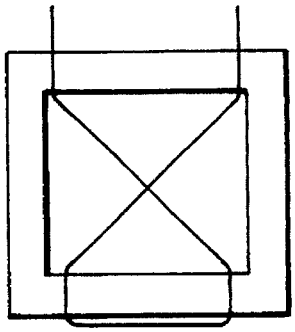
FIG. 3 represents a variety of squeezable bags that were tested alongside the infusion package of the present invention.
Figure 3B:
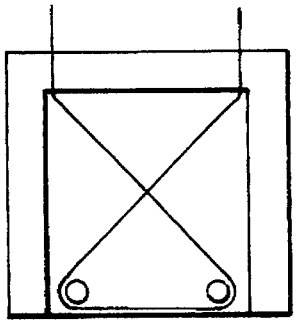
Figure 3C:
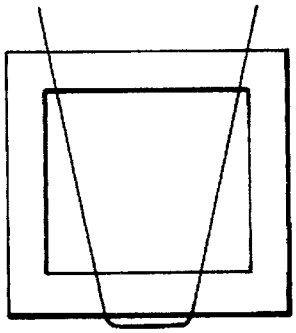
Figure 3D:
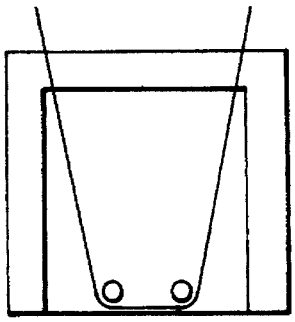
Figure 3E:
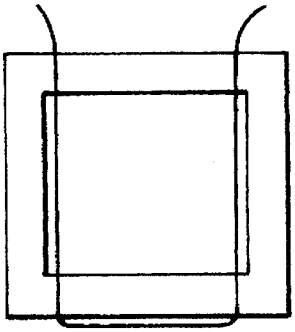
Figure 3F:
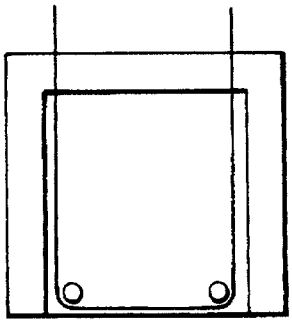
Figure 3G:
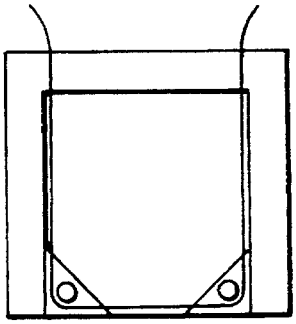

The results of the tests and calculations are as follows:

| Squeeze testing (mass in grams, average values of sample size of three) | | | | |
|---|---|---|---|---|
| Bag design | Dry mass | Wet mass | Sq'd mass | Efficiency |
| FIG. 1 | 2.155 | 10.243 | 6.634 | 44.6% |
| FIG. 3a | 2.144 | 11.186 | 7.855 | 36.8% |
| FIG. 3b | 2.121 | 11.200 | 7.475 | 41.0% |
| FIG. 3c | 2.109 | 11.280 | 8.455 | 30.8% |
| FIG. 3d | 2.123 | 11.027 | 7.808 | 36.2% |
| FIG. 3e | 2.159 | 10.932 | 8.185 | 31.3% |
| FIG. 3f | 2.129 | 11.312 | 7.286 | 43.8% |
| FIG. 3g | 2.120 | 11.167 | 7.531 | 40.2% |

(NB spot welds were 4 mm in diameter)

These results demonstrate show that the infusion package of the present invention (FIG. 1) is superior to the others tested in terms of squeezing efficiency as herein defined.

The results also suggest those bags that have a drawstring that can slide freely within the interior of the bags, that is opposed to being anchored (ie permanently secured) to the base of the bag, tend to be more "squeeze efficient" bags. That is best seen when comparing the results that relate to the bags shown in FIGS. 3*e–g*.

In FIG. 3*e* the drawstring is anchored to the base of the bag, in FIG. 3*g* the drawstring is constrained against the base of the bag by spot welds but light oversealing in each of the corners causes the drawstring to resist any sliding movement with respect to the spot welds, while in FIG. 3*f* the drawstring is only constrained against the base of the bag by spot welds so that the drawstring is free to slide between the spot welds and the base of the bag. The squeezing efficiency of the bags increases as the drawstring is allowed more freedom to move with respect to the base of the bag. This may be because when the drawstring is anchored to the base of the bag the bag can only contract in one dimension (ie from top to bottom) whereas when the drawstring is free to move between the spot welds and the base of the bag the bag can contract in two dimensions (ie from top to bottom and side to side).

It was also noted that the bags having anchored drawstrings were decidably more likely to fail during the squeezing action. For example the drawstring would tear the base of the bag. The foregoing describes the invention and preferred forms thereof. However it should be appreciated that one skilled in the art would readily recognise that various modifications to the bags are possible and therefore it should be understood that the preferred embodiments described above have been presented solely for the purpose of providing a complete disclosure of the invention. The scope of the monopoly for which protection is sought is therefore defined solely by the following claims.

We claim:

1. A package for containing a flowable infusible material comprising a closed bag made from a porous material which is defined by a first side, a second side that opposes the first side and two other sides, said package having a drawstring that has two ends which pass out of the interior of the package in which the infusible material is contained via a first exit point located adjacent one end of the first side and a second exit point located adjacent the other end of the first side, the package being characterised in that the drawstring is constrained within the bag by being urged adjacent the ends of the second side and at some intermediate point along each of said other sides by spot welds wherein pulling the ends of the drawstring in substantially opposite directions causes the drawstring to move relative to the sides it engages and thus enable the package to collapse.

2. A package according to claim 1, wherein the drawstring is constrained adjacent the midpoint of each of said other side walls.

* * * * *